US008443619B2

(12) United States Patent
Cho

(10) Patent No.: US 8,443,619 B2
(45) Date of Patent: May 21, 2013

(54) ICE MAKING UNIT AND REFRIGERATOR HAVING THE SAME

(75) Inventor: Young Jin Cho, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 592 days.

(21) Appl. No.: 12/314,452

(22) Filed: Dec. 10, 2008

(65) Prior Publication Data

US 2009/0178431 A1 Jul. 16, 2009

(30) Foreign Application Priority Data

Jan. 16, 2008 (KR) ..... 10-2008-0004971
Jan. 16, 2008 (KR) ..... 20-2008-0000663 U
Feb. 11, 2008 (KR) ..... 10-2008-0012045

(51) Int. Cl.
*A23G 9/001* (2006.01)

(52) U.S. Cl.
USPC ..... 62/345; 62/137

(58) Field of Classification Search
USPC ..... 62/345.137
See application file for complete search history.

(56) References Cited

U.S. PATENT DOCUMENTS 6,085,542 A * 7/2000 Johnson et al. ..... 62/441
2003/0075948 A1* 4/2003 De Gaillard ..... 296/146.8
2004/0177638 A1* 9/2004 Onishi et al. ..... 62/351
2006/0086130 A1* 4/2006 Anselmino et al. ..... 62/344
2006/0250060 A1* 11/2006 Rose et al. ..... 312/401

FOREIGN PATENT DOCUMENTS

KR 1989-0002079 4/1989
KR 10-0705182 4/2007
KR 10-0783236 12/2007
WO WO2005026631 * 3/2005

OTHER PUBLICATIONS

Korean Office Action issued Sep. 27, 2012 in corresponding Korean Patent Application No. 10-2008-0012045.

* cited by examiner

*Primary Examiner* — Cheryl J Tyler
*Assistant Examiner* — Jonathan Koagel
(74) *Attorney, Agent, or Firm* — Staas & Halsey LLP

(57) ABSTRACT

An ice making unit and a refrigerator having the same are disclosed. The refrigerator includes an ice making unit to make ice pieces. The ice making unit includes a plurality of ice making trays to form ice pieces, a lever part connected to the ice making trays to simultaneously rotate the ice making trays, and a stopper to prevent one of a pair of rotating shafts of each of the ice making trays from being rotated at a predetermined angle or more so that the ice making trays get twisted when the ice making trays are rotated. Accordingly, ice pieces can be separated from the ice making trays by operation of a single lever.

9 Claims, 8 Drawing Sheets

ICE MAKING UNIT AND REFRIGERATOR HAVING THE SAME

CROSS-REFERENCE TO RELATED APPLICATIONS

This application claims the benefit of Korean Patent Application No. 10-2008-0012045, filed on Feb. 11, 2008, and Korean Utility Model Application No. 20-2008-0000663, filed on Jan. 16, 2008, and Korean Patent Application No. 10-2008-0004971, filed on Jan. 16, 2008 in the Korean Intellectual Property Office, the disclosure of which is incorporated herein by reference.

BACKGROUND

1. Field

Embodiments of the present invention relate to an ice making unit and a refrigerator having the same, and more particularly, to an ice making unit including a plurality of ice making trays and a refrigerator having such an ice making unit.

2. Description of the Related Art

In general, a refrigerator is an apparatus comprising components for constituting a refrigerating cycle, and serves to freeze or refrigerate stored goods therein by generating cool air using the components for constituting the refrigerating cycle. A refrigerator may comprise an ice making unit mounted in a freezing chamber to make ice pieces.

An example of an ice making unit mounted in a refrigerator is disclosed in Korean Patent Registration No. 10-705182.

An ice tray assembly for a refrigerator disclosed in the above patent reference includes a case, a plurality of ice trays arranged up and down in the case to freeze water stored therein, one of which is rotatably provided and the others of which are rotated interlockingly with the rotation of one of the ice trays, a lever connected to one of the plurality of ice trays to serve to drop ice pieces stored in the ice trays down below the case by rotation thereof, and a connecting gear connected to the lever so as to interlock with the rotation of the lever and serving to transmit the rotating force of one of the ice trays, which is connected with the lever, to another of the ice trays.

However, the conventional ice tray assembly (hereinafter, referred to as an "ice making unit") for a refrigerator disclosed in the above patent reference is structured such that the plurality of ice trays are connected to each other by the connecting gear and the lever is directly connected to one of the ice trays. Thus, in order to separate ice pieces from the ice trays by rotating the ice trays, a user should rotate the lever by 90 degrees or more, thereby causing inconvenience to a user.

Further, because the amount of rotation of the lever is large, sufficient space for the rotation of the lever should be provided. Thus, space utilization is low.

Further, because the ice pieces made in the ice trays adhere to inner surfaces of the ice trays, it is not easy to separate the ice pieces from the ice trays only by rotating the ice trays.

Further, because a conventional water supply tank for supplying water to the ice trays is mounted to or demounted from the case while moving up and down, sufficient space should be provided above the ice making unit in order to separate the water supply tank from the case. Therefore, a conventional refrigerator has a problem such that it is difficult to efficiently utilize space above the ice making unit.

Further, it is necessary to clean the ice making trays when the ice making trays are covered with foreign materials due to long term use. However, because the ice making trays cannot be separated from the ice making case, it is very inconvenient to clean the ice making trays.

SUMMARY

Embodiments of the present invention have been made in order to solve the above problems. It is an aspect of the invention to provide an ice making unit enabling a user to separate ice pieces from ice making trays while minimizing the amount of rotation of a lever and a refrigerator having such an ice making unit.

It is another aspect of the invention to provide an ice making unit enabling a user to easily separate ice pieces from ice trays and a refrigerator having such an ice making unit.

It is a further aspect of the invention to provide a refrigerator enabling a user to more efficiently utilize inner space of the refrigerator.

It is a further aspect of the invention to provide a refrigerator enabling a user to more conveniently clean ice making trays.

Additional aspects and/or advantages will be set forth in part in the description which follows and, in part, will be apparent from the description, or may be learned by practice of the invention.

In accordance with an aspect of the invention, there is provided a refrigerator including an ice making unit to make ice pieces, the ice making unit including a plurality of ice making trays to form ice pieces, a lever part connected to the ice making trays to simultaneously rotate the ice making trays, and a stopper to prevent one of a pair of rotating shafts of each of the ice making trays from being rotated at a predetermined angle or more so that the ice making trays get twisted when the ice making trays are rotated.

The ice making unit may further include a first gear part coupled to a driving shaft of the rotating shafts of each of the ice making trays, and a second gear part tooth-engaged with the first gear part and connected to the lever part, the first gear part and the second gear part being disposed between each of the ice making trays and the lever part. The first gear part and the second gear part may have a predetermined gear ratio therebetween so that a rotational angle of the first gear part is larger than a rotational angle of the second gear part.

The ice making unit may further include an ice making case to accommodate the ice making trays, and the stopper may be positioned at a predetermined distance from a driven shaft of each of the ice making trays. The ice making case may be provided with a stopper guide part to guide the stopper to rotate at a predetermined angle.

The gear ratio may be set to 1:2.5 to 3.5.

The ice making unit may further include an ice making case defining an exterior appearance, and a water supply tank to supply water to the ice making trays. The water supply tank may be mounted in the ice making case so as to move forward and backward. The ice making case may be formed with an opening, through which the water supply tank is mounted so as to move forward and backward. The water supply tank may be mounted in or demounted from the ice making case while moving forward and backward.

The water supply tank may be mounted through a side of the ice making case, and positioned below an upper cover of the ice making case.

The water supply tank may be formed with an outlet hole at a rear lower end thereof, through which water in the water supply tank can be discharged. The water supply tank may be formed with an opening/closing valve at a rear end thereof to open or close the outlet hole, and an elastic member to elastically support the opening/closing valve.

The ice making case may be formed with a pressing protrusion at an inner rear surface thereof to operate the opening/closing valve. The opening/closing valve may include a hinge part rotatably mounted to the rear end of the water supply tank, a valve part to open or close the outlet hole by rotating on the hinge part, and a pressing part to rotate the hinge part and the valve part by being pressed the pressing protrusion. The hinge part, the valve part and the pressing part may be formed integrally with each other.

The ice making unit may further include an ice making case to accommodate the ice making trays. The ice making trays may be mounted in or demounted from the ice making case.

The ice making case may be formed with an opening at a predetermined portion thereof, through which the ice making trays are mounted in or demounted from the ice making case.

The ice making case is provided with a transparent window at the opening to open or close the opening. The transparent window may be made of a transparent material, and may have an upper end hingedly coupled to an upper portion of the opening.

The ice making unit may further include guide parts to respectively guide the pair of rotating shafts so that the ice making trays are removably mounted in the ice making case.

The first gear part may include a shaft mounting slit, through which the driving shaft is inserted, and mounting guide parts provided at both side portions of an inlet of the shaft mounting slit so as to guide the driving shaft to the shaft mounting slit.

The ice making unit may further include a guide part to guide mounting and demounting of the driven shaft of the rotating shafts. The stopper guide part may be branched from the guide part.

In accordance with another aspect of the invention, there is provided an ice making unit including a plurality of ice making trays to form ice pieces, an ice making case to accommodate the ice making trays, a lever part connected to the ice making trays to simultaneously rotate the ice making trays, and a stopper to prevent one of a pair of rotating shafts of each of the ice making trays from being rotated at a predetermined angle or more so that the ice making trays get twisted when the ice making trays are rotated.

The ice making case may include guide parts to respectively guide the pair of rotating shafts so that the ice making trays are removably mounted in the ice making case.

The ice making unit may further include a water supply tank to supply water to the ice making trays. The ice making case may be formed with an opening, through which the water supply tank is mounted so as to move forward and backward. The water supply tank may be mounted in or demounted from the ice making case while moving forward and backward through the opening.

The water supply tank may be mounted through a side of the ice making case, and positioned below an upper cover of the ice making case.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
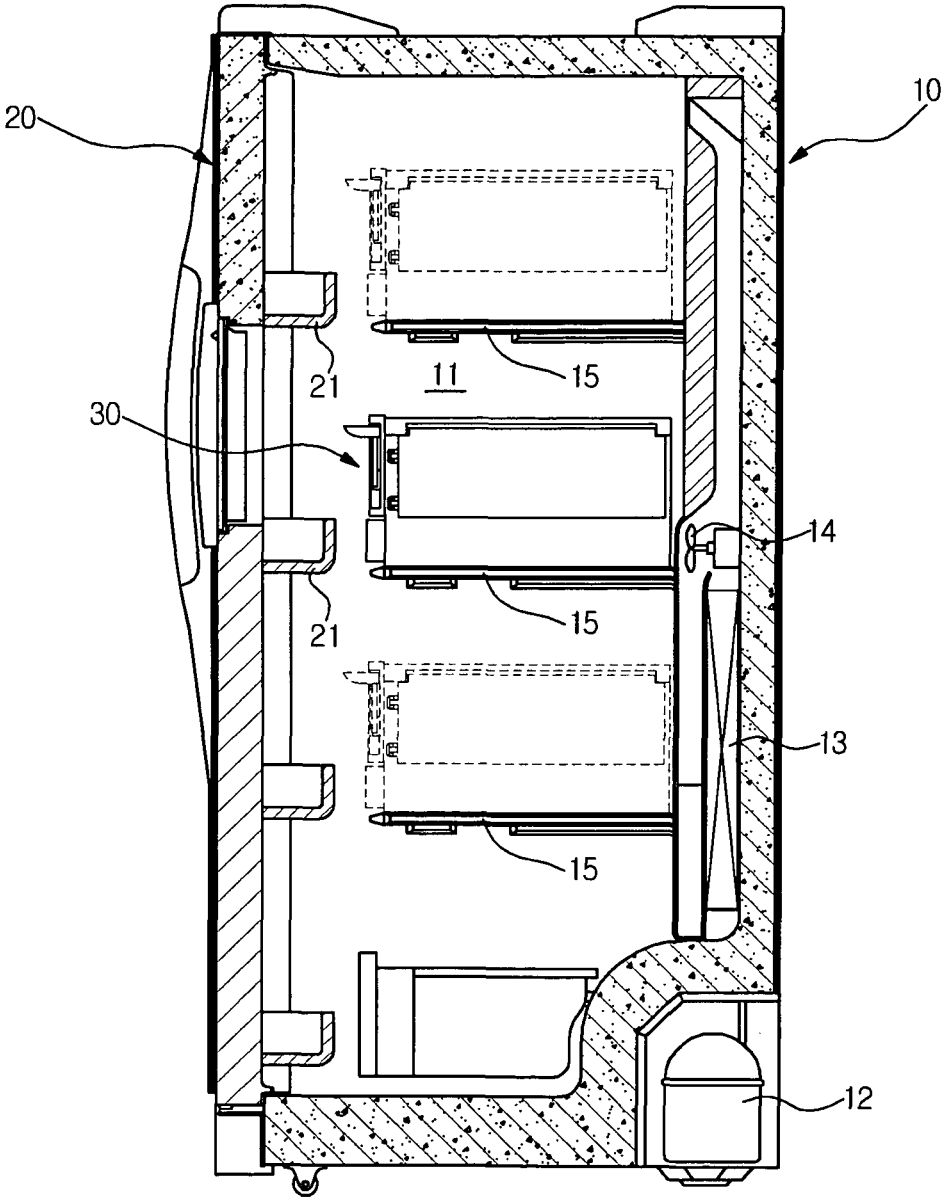
FIG. 1 is a side-sectional view of a refrigerator according to embodiments of the present invention.

Reference will now be made in detail to the embodiments, examples of which are illustrated in the accompanying drawings, wherein like reference numerals refer to the like elements throughout. The embodiments are described below to explain the present invention by referring to the figures.

As shown in FIG. 1, a refrigerator according to embodiments of the present invention includes a main body 10 forming an outer appearance, a freezing chamber 11 formed in the main body 10, the freezing chamber 11 having an opened front portion to store goods in a frozen state, and a door 20 hingedly coupled to a predetermined portion of the main body 10 to open or close the freezing chamber 11.

A compressor 12 to compress refrigerant is mounted in a lower rear portion of the main body 10. An evaporator 13 to generate cool air and a blowing fan 14 to make the cool air generated from the evaporator 13 circulate in the freezing chamber 11 by generating suction force and blowing force are mounted in a rear portion of the freezing chamber 11. So as to efficiently sort and store a plurality of goods, a plurality of shelves 15 are provided in the freezing chamber 11. A plurality of door guards 21 are provided at an inner surface of the door 20 so as to store canned goods, beverage containers or the like.

The refrigerator according to embodiments of the present invention further comprises an ice making unit 30 mounted in the freezing chamber 11 so as to make ice pieces. The ice making unit 30 employed in the refrigerator according to embodiments of the present invention is provided as an independent unit, and is removably mounted in the freezing chamber 11. The ice making unit 30 is designed so as to be laid on each of the shelves 15 in the freezing chamber 11. Therefore, as shown by the dashed outlines in FIG. 1, the position of the ice making unit 30 can be freely changed in an up/down direction as needed.

Figure 2:
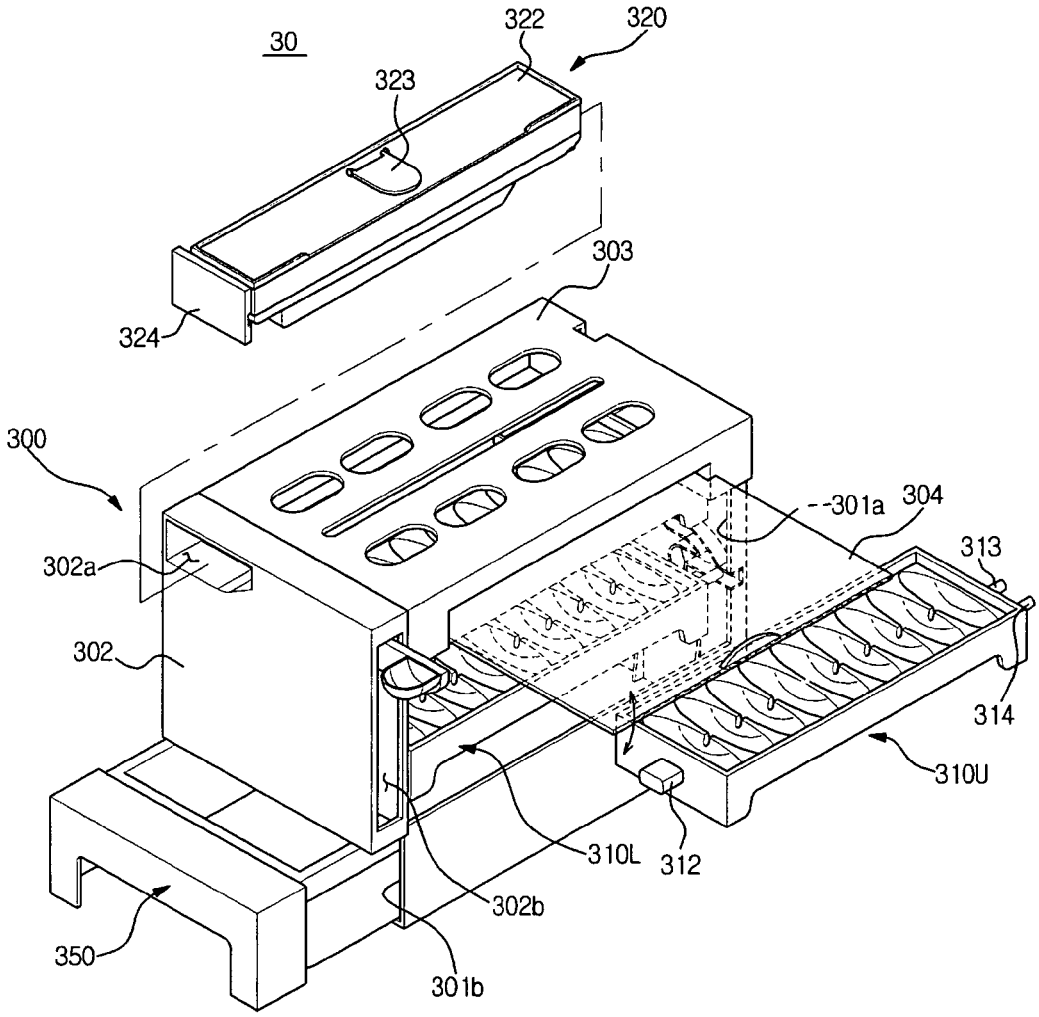
FIG. 2 illustrates a perspective view of an ice making unit of the refrigerator according to embodiments of the present invention.
Figure 3:
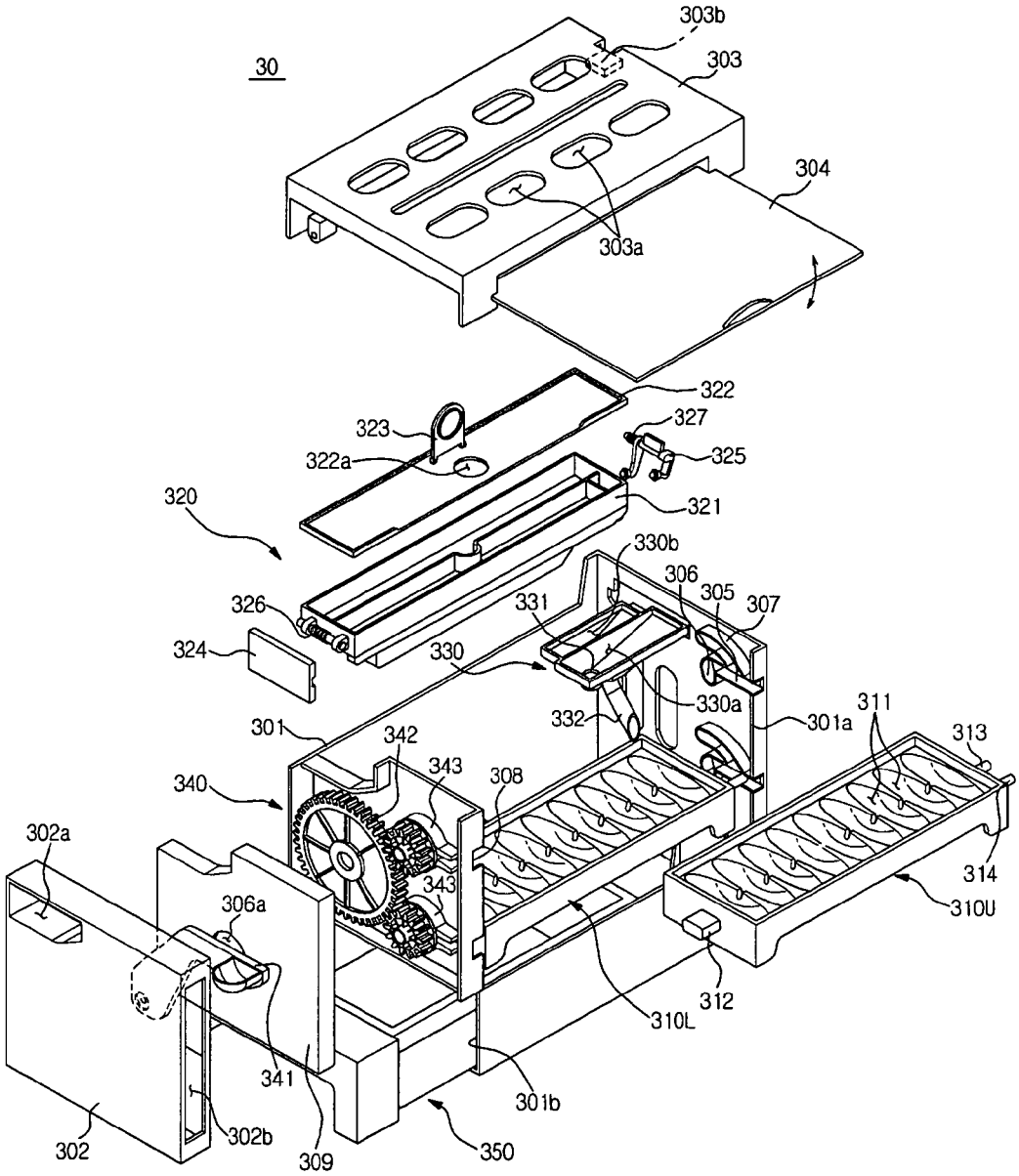
FIG. 3 illustrates an exploded perspective view of the ice making unit of the refrigerator according to embodiments of the present invention.

As shown in FIGS. 2 and 3, the ice making unit 30 includes an ice making case 300 forming an outer appearance, a plurality of ice making trays 310U and 310L disposed in the ice making case 300 to make ice pieces, a water supply tank 320 disposed above the ice making trays 310U and 310L to store water to be supplied to the ice making trays 310U and 310L, a guide tray 330 to guide the water in the water supply tank 320 to be dispersedly supplied to the plurality of ice making trays 310U and 310L, an ice separating device 340 to separate ice pieces made in the ice making trays 310U and 310L from the ice making trays 310U and 310L, and an ice storage container 350 disposed below the ice making trays 310U and 310L to store the ice pieces separated from the ice making trays 310U and 310L.

The ice making case 300 includes a case body 301 mounted with the ice separating device 340 at a front surface thereof and the ice making trays 310U and 310L therein, a front cover 302 to cover the front surface of the case body 301, and an upper cover 303 to define an upper surface of the case body 301.

The case body 301 of the ice making case 300 is formed with a first opening 301*a* at a predetermined portion thereof, through which the ice making trays 310U and 310L can pass. Therefore, the ice making trays 310U and 310L can be mounted in or demounted from the case body 301 through the first opening 301*a*. The case body 301 is mounted with a transparent window 304 at the first opening 301*a* in order to open or close the first opening 301*a*. The transparent window 304 is made of a transparent material, and an upper end of the transparent window 304 is hingedly coupled to an upper portion of the first opening 301*a*, so as to open or close the first opening 301*a* while rotating.

In an embodiment of the present invention, the upper end of the transparent window 304 is hingedly coupled to a predetermined portion of the upper cover 303 defining the upper surface of the ice making case 300. Accordingly, even when the first opening 301*a* is in a closed state, a user can observe an ice making state of water stored in the ice making trays 310U and 310L through the transparent window 304.

The upper cover 303 of the ice making case 300 is formed with a plurality of through-holes 303*a*, through which cool air in the freezing chamber 11 (FIG. 1) can enter the case body 301.

The front cover 302 of the ice making case 300 is formed with a second opening 302*a* at an upper portion thereof, in which the water supply tank 320 is mounted so as to move forward and backward. Therefore, the water supply tank 320 can be mounted in or demounted from the ice making case 300 through the second opening 302*a*. The case body 301 is formed with a third opening 301*b* at a lower portion of the front surface thereof, in which the ice storage container 350 is mounted so as to move forward and backward. Therefore, the ice storage container 350 can be mounted in or demounted from the ice making case 300 through the third opening 301*b*.

In an embodiment of the present invention, a pair of ice making trays 310U and 310L are arranged up and down, parallel to each other For convenience of explanation, the ice making tray 310U disposed at an upper position will be referred to as an upper ice making tray 310U, and the ice making tray 310L disposed at a lower position will be referred to as a lower ice making tray 310L.

The pair of ice making trays 310U and 310L are removably and rotatably mounted to the upper portion and the lower portion of the ice making case 300, and are arranged parallel to each other. Each of the ice making trays 310U and 310L is formed with a plurality of ice making recesses 311 at an upper surface thereof. Each of the ice making recesses 311 is formed concave, and has an arc-shaped section.

Each of the ice making trays 310U and 310L is provided with a pair of rotating shafts 312 and 313. A driving shaft 312 is protrudingly formed at a front end of each of the ice making trays 310U and 310L. The driving shaft 312 is connected to the ice separating device 340, in order to receive rotating force of the ice separating device 340 and rotate the ice making trays 310U and 310L. A driven shaft 313 is protrudingly formed at a rear end of each of the ice making trays 310U and 310L, by which the ice making trays 310U and 310L are rotatably supported to the ice making case 300. A stopper 314 is protrudingly formed at a portion of the rear end of each of the ice making trays 310U and 310L. The stopper 314 is positioned at a predetermined distance from the driven shaft 313, and serves to restrict a rotational angle of the ice making trays 310U and 310L.

Guide parts 305 and 308 are provided at both side surfaces of the first opening 301*a* formed at the case body 301 of the ice making case 300. The guide parts 305 and 308 serve to guide the driving shaft 312 and the driven shaft 313 of each of the ice making trays 310U and 310L to be inserted into or removed from the ice making case 300.

A driven shaft guide part 305 is protrudingly provided at a rear side surface of the first opening 301*a*, in order to guide the driven shaft 313 to a seat part 306.

A driving shaft guide part 308 formed at a front side surface of the first opening 301*a* has a recess shape, in order to guide the driving shaft 312 to a below-described first gear part 343 of the ice separating device 340.

The driving shaft 312 is inserted through the driving shaft guide part 308 formed at the front side surface of the first opening 301*a*, and is coupled to the first gear part 343 of the ice separating device 340. The driven shaft 313 is inserted through the driven shaft guide part 305, and is rotatably supported by the seat part 306. Accordingly, the ice making trays 310U and 310L are rotated by the rotation of the first gear part 343.

The case body 301 of the ice making case 300 is formed with a stopper guide part 307, corresponding to the stopper 314 formed at a portion of the rear end of each of the ice making trays 310U and 310L. The stopper guide part 307 is formed in an arc shape, centering on the seat part 306, and serves to guide the movement of the stopper 314 and restrict a rotational angle of the stopper 314.

The stopper guide part 307 is branched from the driven shaft guide part 305, and extends in a circumferential direction, centering on the seat part 306, by a predetermined length.

Therefore, when the ice making trays 310U and 310L are rotated, the stopper 314 moves in a circumferential direction along the stopper guide part 307, and then is caught by an end of the stopper guide part 307, thereby restricting the rotation of the driven shaft 313.

Preferably, the stopper guide part 307 is designed to restrict the rotational angle of the stopper 314 to 90 degrees to 120 degrees, centering on the driven shaft 313, so as to separate ice pieces down from the ice making trays 310U and 310L. In this embodiment, the stopper guide part 307 is formed to restrict the rotational angle of the stopper 314 to 95 degrees.

In an embodiment of the present invention, because the pair of ice making trays 310U and 310L are arranged up and down, the driving shaft guide parts 308, the driven shaft guide parts 305 and the stopper guide parts 307 are respectively formed at the inner upper portion and the inner lower portion of the case body 301.

Figure 4:
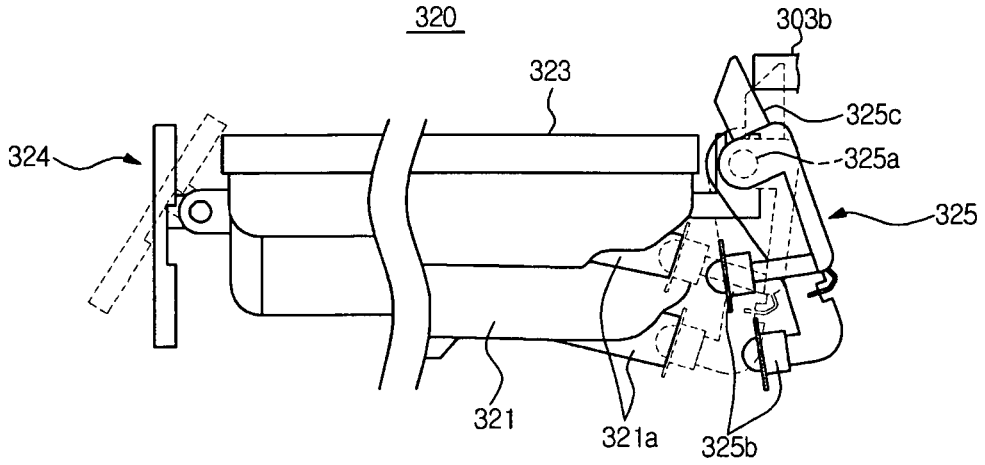
FIG. 4 illustrates a side view of a water supply tank employed in the ice making unit of the refrigerator according to embodiments of the present invention.

The water supply tank 320 includes a water supply tray 321 having an opened top portion to store water therein, and a water supply cover 322 to cover the opened top portion of the water supply tray 321. The water supply cover 322 is formed with an inlet hole 322*a*, through which water can be supplied to the water supply tray 321. A cap 323 is hingedly coupled to the water supply cover 322 to open or close the inlet hole 322*a*. As shown in FIG. 4, the water supply tray 321 is formed with outlet holes 321*a* at a rear portion thereof, through which the water in the water supply tray 321 can be discharged. Inner space of the water supply tray 321 is divided into two sections, and the outlet holes 321*a* are provided in pairs, so that the water in the water supply tray 321 can be dispersedly supplied to the pair of ice making trays 310U and 310L.

Referring to FIG. 3, a knob 324 is rotatably mounted to a front end of the water supply tray 321 of the water supply tank 320, so that a user can easily move the water supply tank 320 forward and backward by applying force to the water supply tank 320. The knob 324 is elastically supported by a first elastic member 326. Preferably, the first elastic member 326 is configured as a torsion spring. An opening/closing valve 325 is rotatably mounted to a rear end of the water supply tray 321 to open or close the outlet hole 321*a* (FIG. 4). The opening/closing valve 325 is elastically supported by a second elastic member 327. Preferably, the second elastic member 327 is configured as a torsion spring.

As shown in FIG. 4, the opening/closing valve 325 includes a hinge part 325*a* rotatably mounted to a rear end of the water supply tank 320, a valve part 325*b* to open or close the outlet hole 321*a* by rotating on the hinge part 325*a*, and a pressing part 325*c* protruding from the hinge part 325*a* to receive external force and rotate the hinge part 325*a*. The hinge part 325*a*, the valve part 325*b* and the pressing part 325*c* are formed integrally with each other. The aforementioned second elastic member 327 (FIG. 3) is mounted to the hinge part 325*a*. A pressing protrusion 303*b* (FIG. 3) is formed at an inner rear surface of the upper cover 303 of the ice making case 300. The pressing protrusion 303*b* protrudes forward so as to rotate the hinge part 325*a* by pressing the pressing part 325*c*.

When a user applies force to an upper portion of the knob 324, the knob 324 is rotated, and a lower portion of the knob 324 is protruded forward. By using the protruded lower portion of the knob 324, a user can easily move the water supply tank 320 forward and backward.

When a user inserts the water supply tank 320 into the ice making case 300 through the second opening 302*a*, the pressing part 325*c* of the opening/closing valve 325 is pressed by the pressing protrusion 303*b*, and the opening/closing valve 325 is rotated on the hinge part 325*a*. Accordingly, the outlet hole 321*a*, which has been closed by the valve part 325*b*, is opened, so that the water in the water supply tray 321 is supplied to the guide tray 330.

Referring again to FIG. 3, the guide tray 330 is mounted to an upper portion of a rear surface of the case body 301 of the ice making case 300 (FIG. 2). Inner space of the guide tray 330 is divided into two sections, i.e., a first water supply guide part 330*a* and a second water supply guide part 330*b*, so that the water discharged through the pair of outlet holes 321*a* (FIG. 4) can be dispersedly supplied to the upper ice making tray 310U and the lower ice making tray 310L.

The guide tray 330 is disposed such that the first water supply guide part 330*a* is positioned above the upper ice making tray 310U and the second water supply guide part 330*b* is positioned at a predetermined distance from an area above the upper ice making tray 310U. The first water supply guide part 330*a* is formed with a water supply hole 331, through which the water transferred to the first water supply guide part 330*a* can be supplied to the upper ice making tray 310U. The second water supply guide part 330*b* is formed with a water supply pipe 332, which extends downward at a predetermined angle so that the water transferred to the second water supply guide part 330*b* can be supplied to the lower ice making tray 310L.

Therefore, if the water supply tank 320 filled with water is inserted into the ice making case 300 (FIG. 2), the outlet holes 321*a* (FIG. 4) are opened, and the water in the water supply tank 320 is discharged through the outlet holes 321*a* and is transferred to the guide tray 330. A portion of the water transferred to the guide tray 330 is transferred to the upper ice making tray 310U through the water supply hole 331 formed at the first water supply guide part 330*a*, and the remaining water is transferred to the lower ice making tray 310L through the water supply pipe 332 formed at the second water supply guide part 330*b*. As such, because the water in the water supply tank 320 is dispersedly supplied to the pair of ice making trays 310U and 310L via the guide tray 330, the water supply to the pair of ice making trays 310U and 310L is very easily realized.

The ice separating device 340 serves to separate the ice pieces made in the ice making trays 310U and 310L from the ice making trays 310U and 310L by rotating the same. In this embodiment, the ice separating device 340 serves to simultaneously separate the ice pieces from the pair of ice making trays 310U and 310L by rotating the pair of ice making trays 310U and 310L at the same time.

Figure 5:
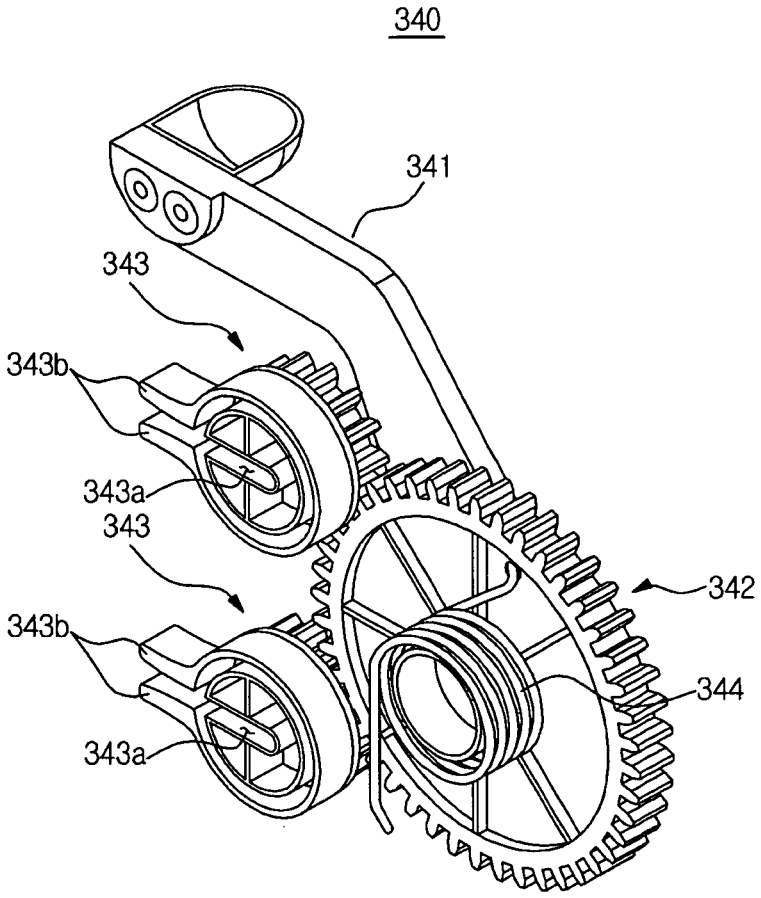
FIG. 5 illustrates a perspective view of an ice separating device employed in the ice making unit of the refrigerator according to embodiments of the present invention.

As shown in FIGS. 3 and 5, the ice separating device 340 includes a lever 341 which is rotated on one end thereof by external force, a second gear part 342 which is rotated by the lever 341, and a pair of first gear parts 343 which are rotated by receiving force from the second gear part 342 to respectively rotate the pair of ice making trays 310U and 310L, each first gear part being coupled with the driving shaft 312 at a center thereof.

As shown in FIG. 3, the second gear part 342 and the pair of first gear parts 343 are mounted to the front surface of the case body 301, and a gear cover 309 to cover the second gear part 342 and the pair of first gear parts 343 is disposed between the case body 301 and the front cover 302. The gear cover 309 is formed with a lever mounting hole 306*a* at a center thereof, through which an end of the lever 341 can be mounted to the second gear part 342. The front cover 302 is formed with a lever guide slot 302*b* at a side portion thereof. The lever guide slot 302*b* is formed long in an up/down direction to guide the up/down movement of the lever 341.

An end of the lever 341 is coupled to a center of the second gear part 342, so that when the lever 341 is rotated on the end thereof, the second gear part 342 is rotated together with the lever 341. The pair of first gear parts 343 are arranged up and down at the front surface of the ice making case 300 so as to be tooth-engaged with the second gear part 342, so that the first gear parts 343 are rotated together with the second gear part 342, thereby respectively rotating the pair of ice making trays 310U and 310L. The second gear part 342 is elastically supported in a circumferential direction by a third elastic member 344 (FIG. 5), which is configured as a torsion spring, so as to return to an original position after being rotated in a single direction by external force applied to the lever 341.

Referring to FIGS. 3 and 5, each of the first gear parts 343 is formed with a shaft mounting slit 343*a* at a center thereof. The shaft mounting slit 343*a* has a shape corresponding to the driving shaft 312 so that the driving shaft 312 is coupled to the shaft mounting slit 343*a*. Because the ice making trays 310U and 310L are removably mounted in the ice making case 300, one end of the shaft mounting slit 343*a* is opened so that the driving shaft 312 can be inserted into or removed from the shaft mounting slit 343*a*. Each of the ice making trays 310U and 310L can be mounted to or demounted from the first gear part 343 through the shaft mounting slit 343*a*. Mounting guide parts 343*b* are protrudingly formed at both side portions of the opened inlet of the shaft mounting slit 343*a*, in order to guide the driving shaft 312 to the shaft mounting slit 343*a*. The mounting guide parts 343*b* communicate with the driving shaft guide part 308 formed at the case body 301 of the ice making case 300 (FIG. 2).

A gear ratio between the first gear part 342 and the second gear part 343 may be set such that a rotational angle of the first gear part 343 is larger than a rotational angle of the second gear part 342.

Preferably, the gear ratio is set to 1:2.5 to 3.5 such that when the rotational angle of the second gear part 342 is 40 degrees, the rotational angle of the first gear part 343 is 100 to 140 degrees. Accordingly, though the movement of the lever 341 is small, the rotation of the driving shaft 312 connected to the first gear part 343 is large enough to separate ice pieces down from the ice making trays 310U and 310L. As a result, moving space of the lever 341 is minimized, and space utilization is improved.

In an embodiment of the present invention, the gear ratio is set to 1:3 such that when the rotational angle of the second gear part 342 is 40 degrees, the rotational angle of the first gear part 343 is 120 degrees.

Figure 6:
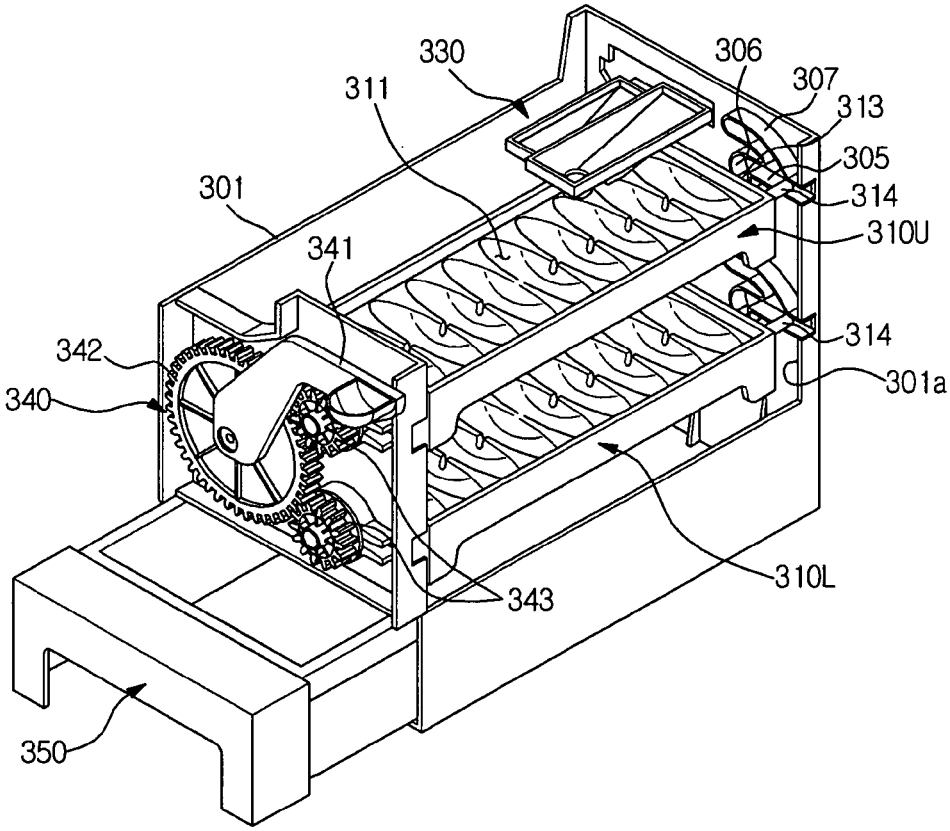
FIGS. 6 to 8 illustrate perspective views showing operation of the ice making unit of the refrigerator according to embodiments of the present invention.
Figure 7:
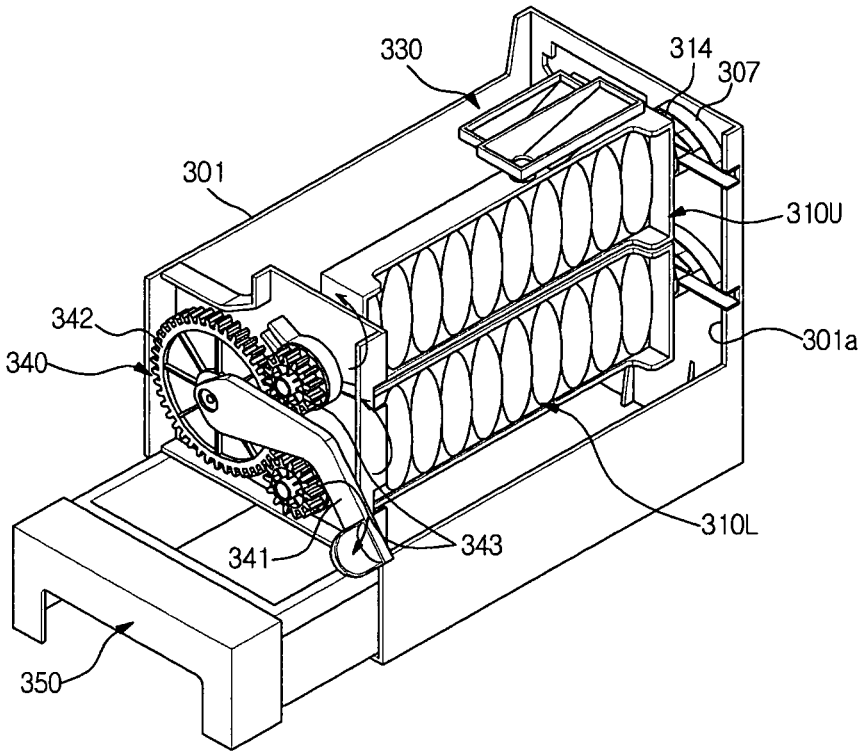

In a state where the ice making recesses 311 are directed upward as shown in FIG. 6, when a user applies force to the lever 341, the lever 341 is rotated on an end thereof, and moves down along the lever guide slot 302*b* (FIG. 3). The second gear part 342 is rotated in a single direction, together with the lever 341, and the pair of first gear parts 343 and the pair of ice making trays 310U and 310L respectively mounted to the pair of first gear parts 343 are rotated as shown in FIG. 7.

Figure 8:
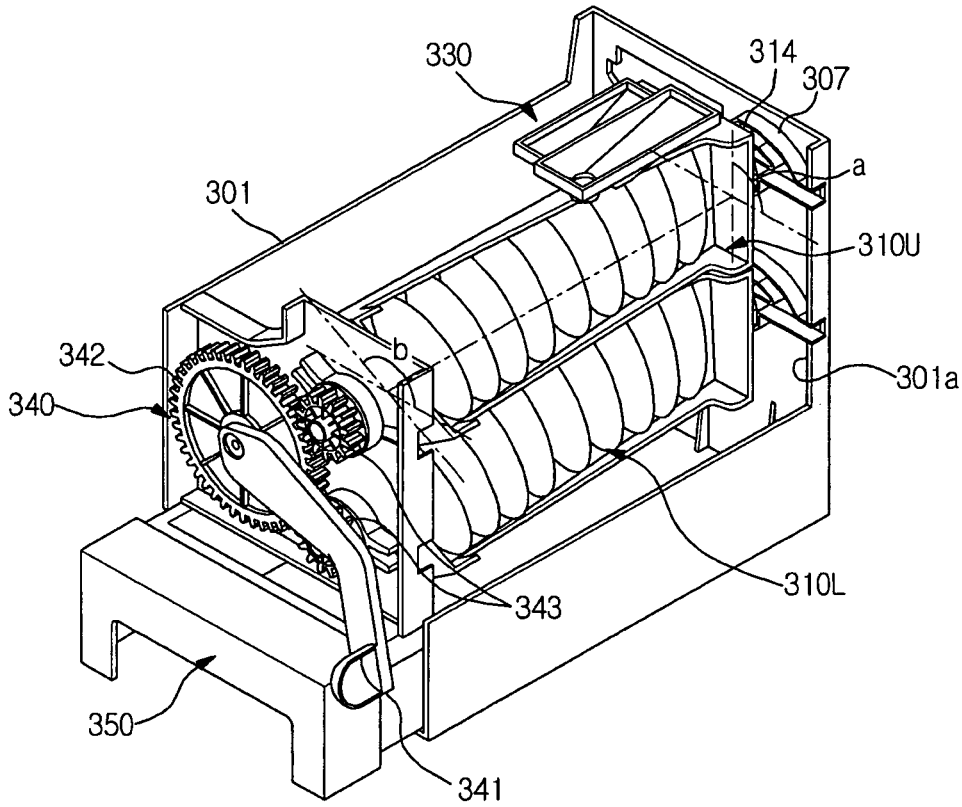

Referring to FIG. 8, at this time, if the lever 341 is further pressed down so that the second gear part 342 is rotated down at 40 degrees from an initial state, as shown in FIG. 8, the rotation of the stopper 314 of each of the ice making trays 310U and 310L is restricted by the stopper guide part 307. Therefore, while the rotation of the driven shaft 313 (FIG. 3) is stopped when the rotational angle (a) of the driven shaft 313 is 95 degrees, the first gear part 343 tooth-engaged with the second gear part 342 is rotated at about 120 degrees. Accordingly, the rotational angle (b) of the driving shaft 312 is 120 degrees. In other words, the rotational angle of the driving shaft 312 and the rotational angle of the driven shaft 313 are different from each other.

Accordingly, the ice making trays 310U and 310L get twisted, and the ice pieces adhering to the inner surface of the ice making trays 310U and 310L are easily separated from the ice making trays 310U and 310L and drop down.

Referring to FIG. 3, as described above, when a user moves the lever 341 at a predetermined angle in an up/down direction along the lever guide slot 302*b*, the ice making trays 310U and 310L are rotated at a large angle according to the aforementioned gear ratio, and the rotational angle of the driving shaft 312 is different from the rotational angle of the driven shaft 313. Accordingly, the pair of ice making trays 310U and 310L get twisted, so as to separate the ice pieces therefrom. In other words, by operating the single lever 341, a user can easily and totally separate the ice pieces from the pair of ice making trays 310U and 310L.

When the external force applied to the lever 341 by a user is removed, the second gear part 342 is rotated in a reverse direction by elastic restoring force of the third elastic member 344 (FIG. 5). Accordingly, as shown in FIG. 6, the lever 341, the first gear part 343 and the pair of ice making trays 310U and 310L return to their original horizontal positions.

As apparent from the above description, and as shown in FIG. 3, according to the ice making unit 30 and the refrigerator having the same of the embodiments of the present invention, the driving shaft 312 and the driven shaft 313 of each of the ice making trays are rotated at angles different from each other by restricting the rotational angle of the driven shaft 313. Accordingly, the ice making trays 310U and 310L get twisted, and as a result ice pieces can be smoothly separated from the ice making trays.

Further, since the first gear part 343 and the second gear part 342 have a predetermined gear ratio therebetween, though the rotational angle of the lever 341 is small, the rotational angle of each of the ice making trays 310U and 310L becomes large, thereby easily separating ice pieces from the ice making trays 310U and 310L. Accordingly, rotating space of the lever 341 is minimized, and space utilization is improved.

Further, since the water supply tank 320 can be removably mounted in the ice making case 300 (FIG. 2) while moving forward and backward, i.e., moving horizontally, it is unnecessary to secure space for mounting or demounting of the water supply tank 320 above the ice making unit 30. Accordingly, inner space of the freezing chamber can be more efficiently utilized.

Further, since the ice making trays 310U and 310L are removably mounted in the ice making case 300 (FIG. 2), when intending to clean the ice making trays 310U and 310L, a user can easily clean the ice making trays by removing the ice making trays from the ice making case.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

an ice making unit to make ice pieces, the ice making unit including:

an ice making case;

a plurality of ice making trays to form ice pieces;

an ice separating device mounted on the ice making case to simultaneously separate the ice pieces from the ice making trays;

a driving shaft protrudingly formed at an end of each of the ice making trays and connected to the ice separating device;

a driven shaft protrudingly formed at the other end of each of the ice making trays;

a stopper preventing the driven shaft of each of the ice making trays from being rotated at a predetermined angle or more wherein the ice making trays are twisted during the rotation of the ice making trays, the driving shaft allowing the ice making trays to be rotated a driving shaft guide part and a driven shaft guide part provided at both ends of the ice making case to guide the driving shaft and the driven shaft of each of the ice making trays to be inserted into and removed from the ice making case, respectively, the driving shaft guide part and the driven shaft guide part each having a slot shape open on one end and each of the ice making trays being disposed to be inserted into and removed from the ice making case by way of the driving shaft guide part and the driven shaft guide part.

2. The refrigerator according to claim 1, wherein the ice separating device further includes a lever part connected to the ice making trays to simultaneously rotate the ice making trays, a first gear part coupled to the driving shaft of each of the ice making trays, and a second gear part tooth-engaged with the first gear part and connected to the lever part, the first gear part and the second gear part being disposed between each of the ice making trays and the lever part, and wherein the first gear part and the second gear part have a predetermined gear ratio therebetween so that a rotational angle of the first gear part is larger than a rotational angle of the second gear part.

3. The refrigerator according to claim 2, wherein the first gear part includes a shaft mounting slit, through which the driving shaft is inserted, and mounting guide parts provided at both side portions of an inlet of the shaft mounting slit so as to guide the driving shaft to the shaft mounting slit.

4. The refrigerator according to claim 1, wherein the ice making unit further includes the ice making case to accommodate the ice making trays, and the stopper is positioned at a predetermined distance from a driven shaft of each of the ice making trays, and wherein the ice making case is provided with a stopper guide part to guide the stopper to rotate at a predetermined angle.

5. The refrigerator according to claim 4, wherein the ice making unit further includes a guide part to guide mounting and demounting of the driven shaft of the pair of rotating shafts, and wherein the stopper guide part is branched from the guide part.

6. The refrigerator according to claim 1, wherein the ice making unit further includes the ice making case defining an exterior appearance, and a water supply tank to supply water to the ice making trays, wherein the water supply tank is mounted in the ice making case so as to move forward and backward, and wherein the ice making case is formed with an opening, through which the water supply tank is mounted so as to move forward and backward, whereby the water supply tank is mounted in or demounted from the ice making case while moving forward and backward.

7. The refrigerator according to claim 6, wherein the water supply tank is formed with an outlet hole at a rear lower end thereof, through which water in the water supply tank can be discharged, and wherein the water supply tank is formed with an opening/closing valve at a rear end thereof to open or close the outlet hole, and an elastic member to elastically support the opening/closing valve.

8. The refrigerator according to claim 7, wherein the ice making case is formed with a pressing protrusion at an inner rear surface thereof to operate the opening/closing valve, wherein the opening/closing valve includes a hinge part rotatably mounted to a rear end of the water supply tank, a valve part to open or close the outlet hole by rotating on the hinge part, and a pressing part to rotate the hinge part and the valve part by being pressed.

9. The refrigerator according to claim 1, wherein the driving shaft guide part is formed in a recess shape at the ice making case, and the driven shaft guide part is protrudingly formed at the ice making case.

* * * * *

UNITED STATES PATENT AND TRADEMARK OFFICE

CERTIFICATE OF CORRECTION

PATENT NO. : 8,443,619 B2
APPLICATION NO. : 12/314452
DATED : May 21, 2013
INVENTOR(S) : Young Jin Cho It is certified that error appears in the above-identified patent and that said Letters Patent is hereby corrected as shown below:

In the Claims

Column 10, Line 49, In Claim 1, delete “rotated” and insert -- rotated; and --, therefor.

Signed and Sealed this
Twenty-second Day of July, 2014

Michelle K. Lee

Michelle K. Lee
*Deputy Director of the United States Patent and Trademark Office*